United States Patent [19]

Crump

[11] 4,179,962

[45] Dec. 25, 1979

[54] COMBINED FLYING CUTOFF AND PUNCH

[75] Inventor: Hubert C. Crump, Galesburg, Ill.

[73] Assignee: Butler Manufacturing Company, Kansas City, Mo.

[21] Appl. No.: 911,684

[22] Filed: Jun. 1, 1978

[51] Int. Cl.[2] ..... B26D 1/56; B26D 9/00

[52] U.S. Cl. ..... 83/300; 83/618; 83/638

[58] Field of Search ..... 83/300, 303, 682, 618, 83/620, 622, 638, 405

[56] References Cited

U.S. PATENT DOCUMENTS

| | | | |
|---|---|---|---|
| 1,211,987 | 1/1917 | Webre | 83/638 X |
| 1,556,581 | 10/1925 | Booth | 83/638 X |
| 1,882,451 | 10/1932 | Sherman | 83/405 |
| 2,301,236 | 11/1942 | Yoder | 83/300 |
| 2,857,966 | 10/1958 | Sarka | 83/303 X |
| 3,021,741 | 2/1962 | Miller | 83/618 |
| 3,217,576 | 11/1965 | Martin | 83/618 X |
| 3,656,385 | 4/1972 | Kimbrell | 83/300 X |
| 3,859,835 | 1/1975 | Allen | 83/638 X |

*Primary Examiner*—Frank T. Yost

*Attorney, Agent, or Firm*—Shoemaker and Mattare, Ltd.

[57] ABSTRACT

A flying panel cutoff and punching machine which punches holes in a panel while that panel is being cut from a continuous length of material in a slugless manner. A camming arrangement drives a punch vertically downward while a shearing blade executes the downward and sideways movement used to cut off a panel in a slugless manner from a continuous length of material.

20 Claims, 11 Drawing Figures

COMBINED FLYING CUTOFF AND PUNCH

BACKGROUND OF THE INVENTION

The present invention relates in general to machines for cutting panels from continuous lengths of material, and, more particularly, to machines of the flying type.

As used herein, the term "flying" refers to a machine that moves in the material flow direction during the operation. Thus, flying shear is a shear that moves in the material flow direction during the shearing operation. Such flying shears are quite desirable as the downward stroke thereof does not interrupt the continuous panel forming operation, thereby increasing manufacturing efficiency.

Flying shears are well known in the art, and can be categorized in one of two general classes. One class of flying shears includes the slug forming machines. Such machines generally utilize a top blade which moves vertically and a bottom blade arrangement which includes two side blades with the top blade moving between the bottom side blades to shear a panel off. These machines thus produce a slug, or piece of material which is wasted. In production lines which produce great numbers of panels, the slug forming machines can become quite uneconomical due to the wasted material.

Another class of flying shears is the type which does not remove a slug during the cutting operation. The slugless cutoff machines have a top blade which moves at an angle with respect to the vertical to cut off a panel in a scissors-type action. Thus, the top blade moves downward and sideways to execute the cutoff operation. The slugless machines are desirable in production lines which produce great numbers of panels due to the cost savings thereof as compared to the slug forming type machines as there is no wasted slug material in the slugless machines. Examples of slugless cutoff dies are shown in literature published by the Hill Engineering Company.

In many panels, the cut end will be the top or the bottom of the panel. Therefore, it is desirable to place an attachment hole of some type at this location. Thus, it is desirable to incorporate a flying punch with the flying shear mechanism. Such flying punch can be located either upstream or downstream of the shear, with respect to the material flow direction. It may even be desirable to locate punches both upstream and downstream of the shear. As used herein, a flying punch is a punch which executes the punching movement while moving in the material flow direction.

In order to define a precise hole, the punch must move vertically with respect to the panel. This requirement appears to preclude use of such punch-shear combinations on the slugless machines due to the sideways component of the blade movement. Indeed, nowhere in the prior art is there any such combination of a flying punch which punches as a cut is being made in a slugless flying shear.

Heretofore, the punching and cutting functions have been performed sequentially and separately rather than concurrently. Thus, one known method includes making a cut to define a panel, then following the cutting step, performing a flying punch operation on the free panel. In such a procedure, the sheared panel is loose and therefore has a tendency to move. In such a case, a punched hole has a tendency to be misshapen and imprecise. Furthermore, there is considerable wear produced on the punches.

A second known method punches first, and then shears the panel. Again, even though the material is not free, as in the first method, there is a danger of elongated holes and wearing and breaking of punches.

If the flying punch is used on the slug forming machine, the vertical movement of the blade permits simultaneous punching and shearing. However, the pressures exerted on the punches in such a slug forming machine can lead to considerable wear and breakage since the stroke needed for the shearing operation is considerably longer and requires more pressure than is needed for the punching alone. In such a case, the punches would have to be hardened steel to reduce wear, yet even using the more expensive hardened steel, wear will still be a major problem.

Thus, there is need for a flying shear device which is of the slugless type for economy, yet can perform a flying punch operation on the panel as the shearing operation is performed to produce accurate holes without inducing inordinate wear on the punches. Such a machine is herein disclosed.

SUMMARY OF THE INVENTION

The machine embodying the teachings of the present invention punches holes in a panel while that panel is being sheared off from a continuous length of material in a flying and slugless manner.

The machine includes a movable die and a fixed die mounted on a moving carriage. A vertically moving ram press is used to actuate the dies and moves downwardly during the shearing and punching operation. The fixed die includes a plurality of punches to define holes in the material prior to shearing a panel containing those holes from the length of material.

The movable die includes a double cam arrangement which converts the ram downward movement into a cam element sideways movement, then back into a cam element downward movement to operate a punch while slide block mounted shear blocks execute a sideways and downward movement to perform a slugless shearing operation.

The machine of the present invention thus provides the advantages incident a flying slugless panel cutoff operation with the advantages realized when panel punching is performed during the panel cutoff step. Thus, waste material is not produced thereby producing cost advantages over known machines while punch life is extended and accurate holes are defined.

Due to the double camming arrangement in the machine of the present invention, the punch travel is considerably shorter than the shear travel. The camming causes the punch to contact the panel first, which thereby locks that punch in position to thus produce a hole which is more accurate and cleaner than in prior devices. Thus, elongated or torn holes are not produced by the punch of the presently disclosed machine. The panel is also locked in position as it is being sheared.

The camming arrangement of the present invention also reduces the downward distance the punch is required to travel as compared to prior devices. Such reduced travel of the punch reduces the possibility of breaking punches, thereby increasing the overall life thereof. Such an advantage has considerable effect on costs of manufacturing.

Additionally, the camming arrangement of the present invention causes the ram press to strike the punch only indirectly as opposed to direct striking in prior machines. The punch of the present invention thus is not required to absorb the entire force of the shearing operation. This advantage also has significant effects on punch breakage, wear and life.

The camming arrangement also allows penetration depth of the punch to be adjusted at the start of a run, and permits sharpening of punches at convenient times.

OBJECTS OF THE INVENTION

It is therefore a main object of the present invention to combine a punching step with a cutoff step in a flying slugless panel cutoff machine.

It is another object of the present invention to reduce the force applied to a punch during a punching operation in a flying cutoff and punch machine.

It is a further object of the present invention to improve the accuracy and precision with which holes are punched in a flying panel cutoff and punch machine.

It is yet another object of the present invention to allow adjustment of penetration depth of a punch in a flying panel cutoff and punch machine.

It is yet a further object of the present invention to reduce the possibility of breaking punches in a flying panel cutoff and punch machine.

It is still another object of the present invention to lock a panel in position as that panel is being sheared in a flying panel cutoff and punch machine.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
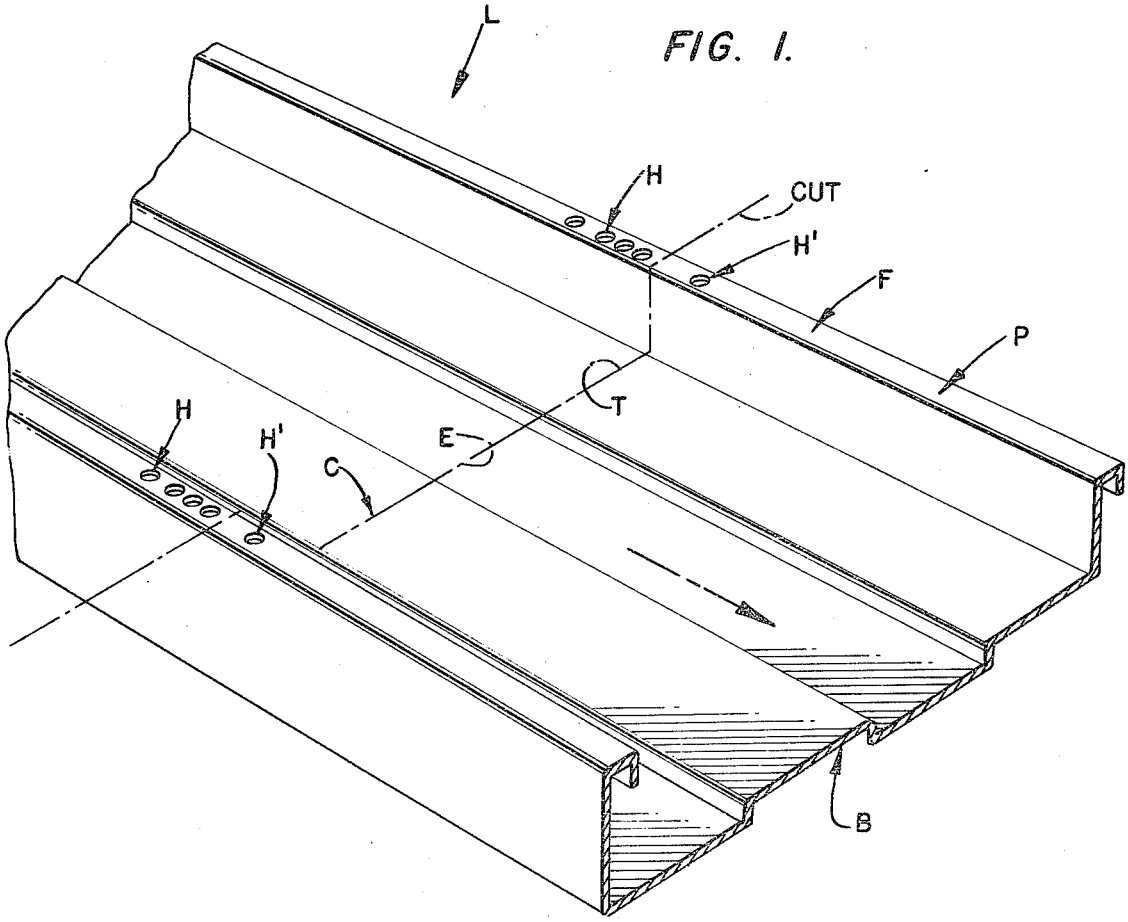
FIG. 1 is a perspective of a panel which is cut off and punched using a machine embodying the teachings of the present invention.

Shown in FIG. 1 is a panel P formed in a continuous process. The panel includes a pair of flanges F connected by web portion B. The flanges each have a plurality of holes H and H' punched therein to receive fasteners or the like. The continuous material L is cut along a line C to define panels of predetermined length. The cut C thus simultaneously defines the trailing edge T of one panel and the leading edge E of the next panel. The pattern of holes H and H' shown in FIG. 1 is exemplary and is not intended as a limitation as any pattern and/or number of holes H and H' can be used without departing from the scope of the present invention.

A machine for cutting and punching the panels P is shown in FIG. 1. The machine is denoted generally by the reference numeral 10. The machine 10 is a flying type, that is, the cut C is made while the cutoff die moves with the panel as that panel moves through the machine. Examples of flying cutoff machines are disclosed by literature published by the Hill Engineering Company, and attention is directed thereto for details thereof.

Figure 2:
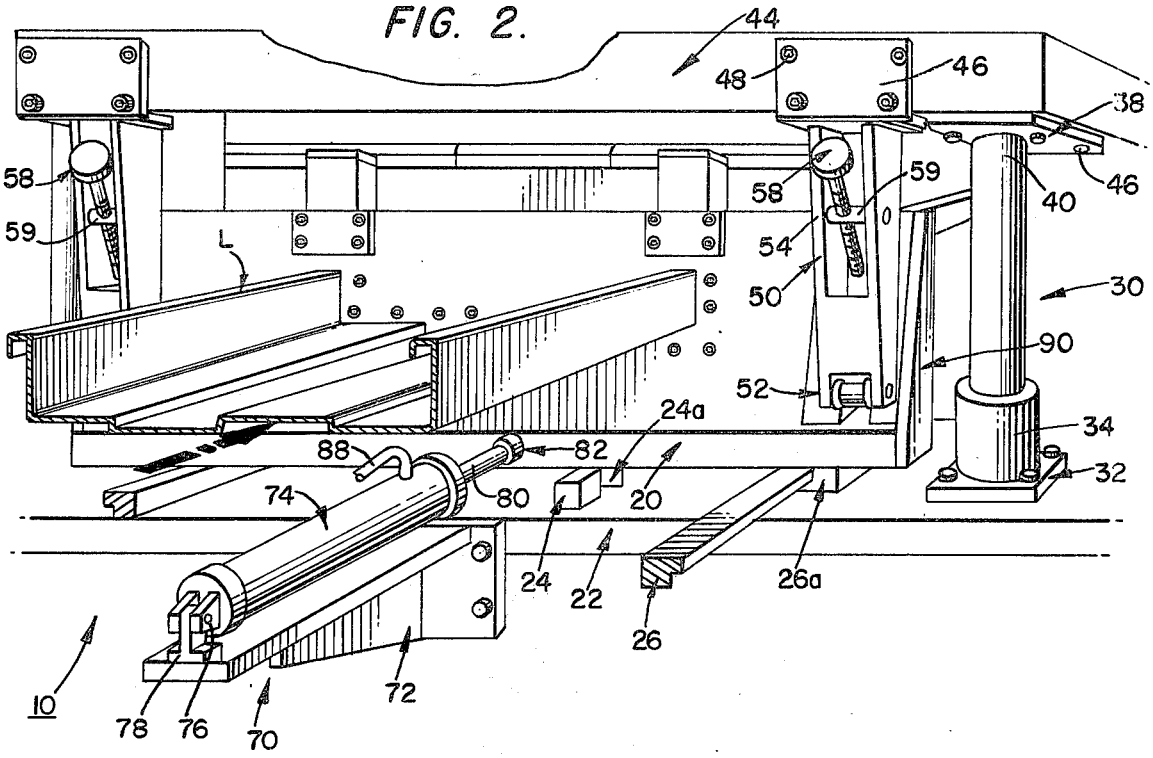
FIG. 2 is a perspective of a machine embodying the teachings of the present invention.
Figure 5:
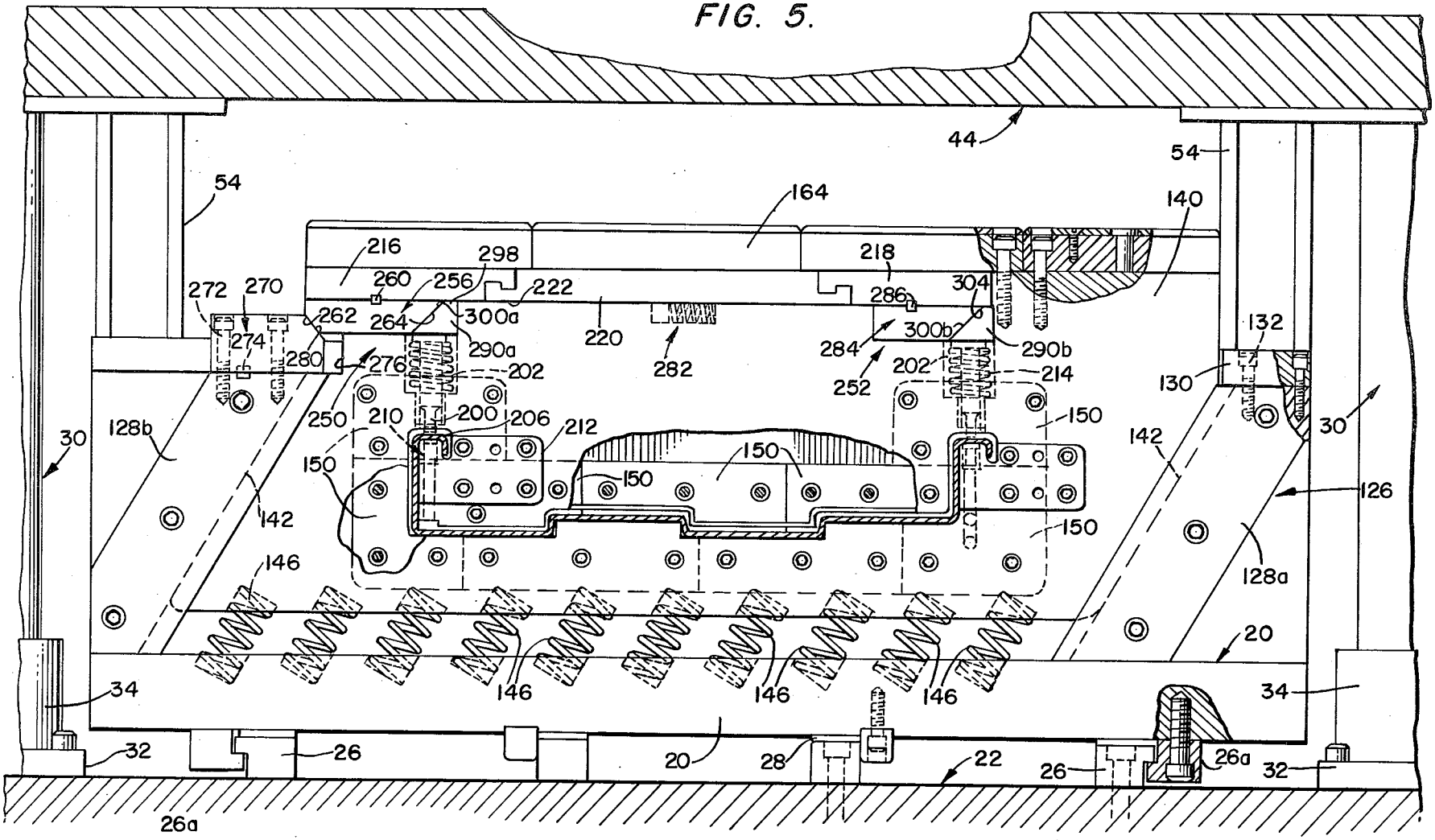
FIG. 5 is a back elevation taken along line 5—5 of FIG. 3 showing the press bed at the beginning of the press ram stroke.

Flying cutoff and punch machine 10 is shown generally in FIG. 2 to include a movable die set 20 mounted on a mounting means 22 by cooperating guide rails 24, 24a and 26, 26a (see FIG. 5). The guide rails can have wear plates 28 mounted thereon. As will be later discussed, the die set, and the equipment mounted thereon, moves along the guide rails to impart the "flying" motion thereto. A pair of support rams, or guide pins 30 (one shown) are mounted on the die set by foot plates 32 and journals 34. The guide pins are slidably received in the journals and the mountings to move vertically. Mounting plates 38 are attached to upper ends 40 of the rams and are attached to a press ram 44 by fasteners such as bolts 46 to thereby attach the guide pins 30 to the press ram 44 and thus impart the vertical movement of the guide pins 30 to the press ram 44.

Figure 3:
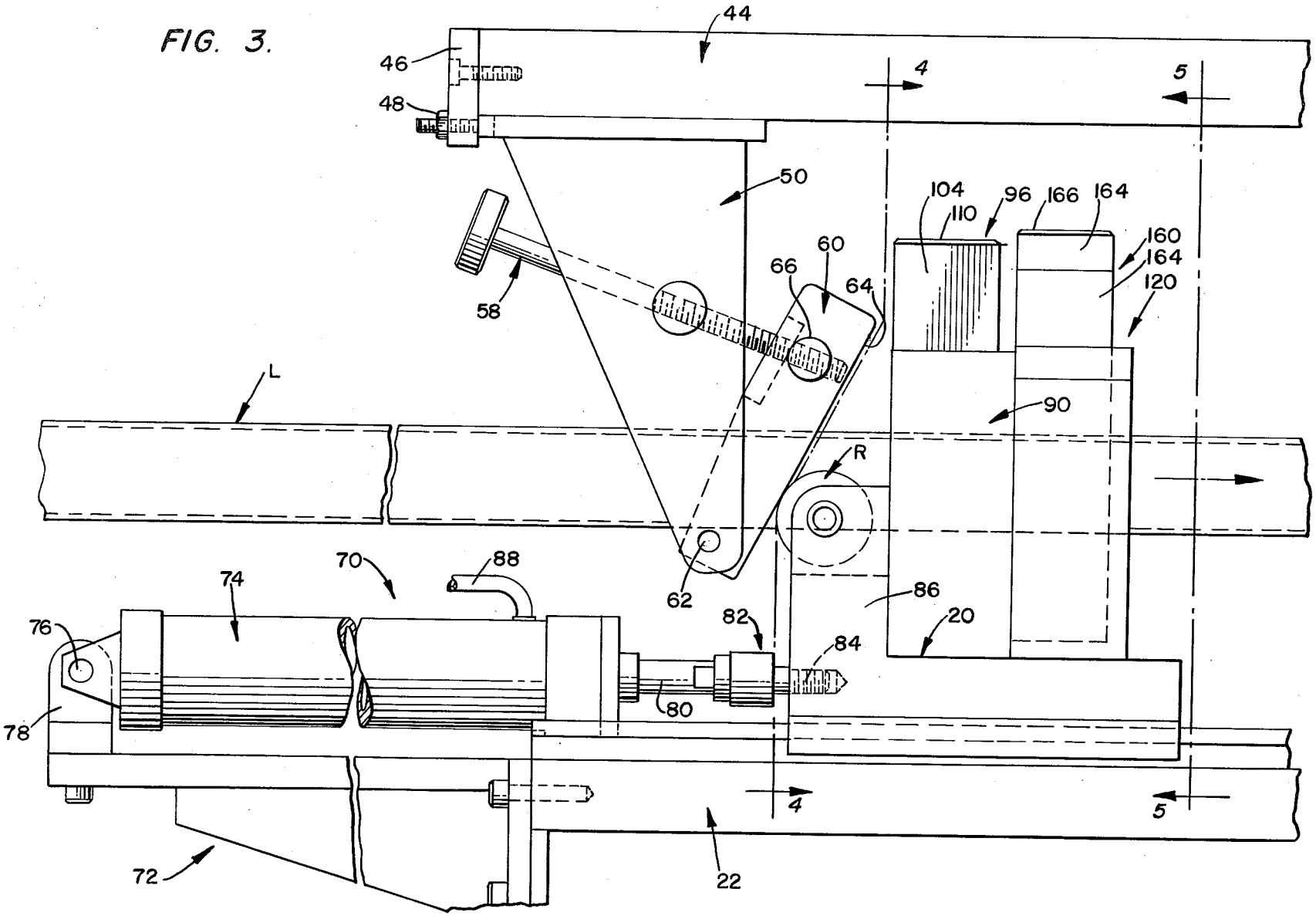
FIG. 3 is a side elevation of a press bed moving apparatus used in a machine embodying the teachings of the present invention showing the press bed at the beginning of a press ram stroke.
Figure 4:
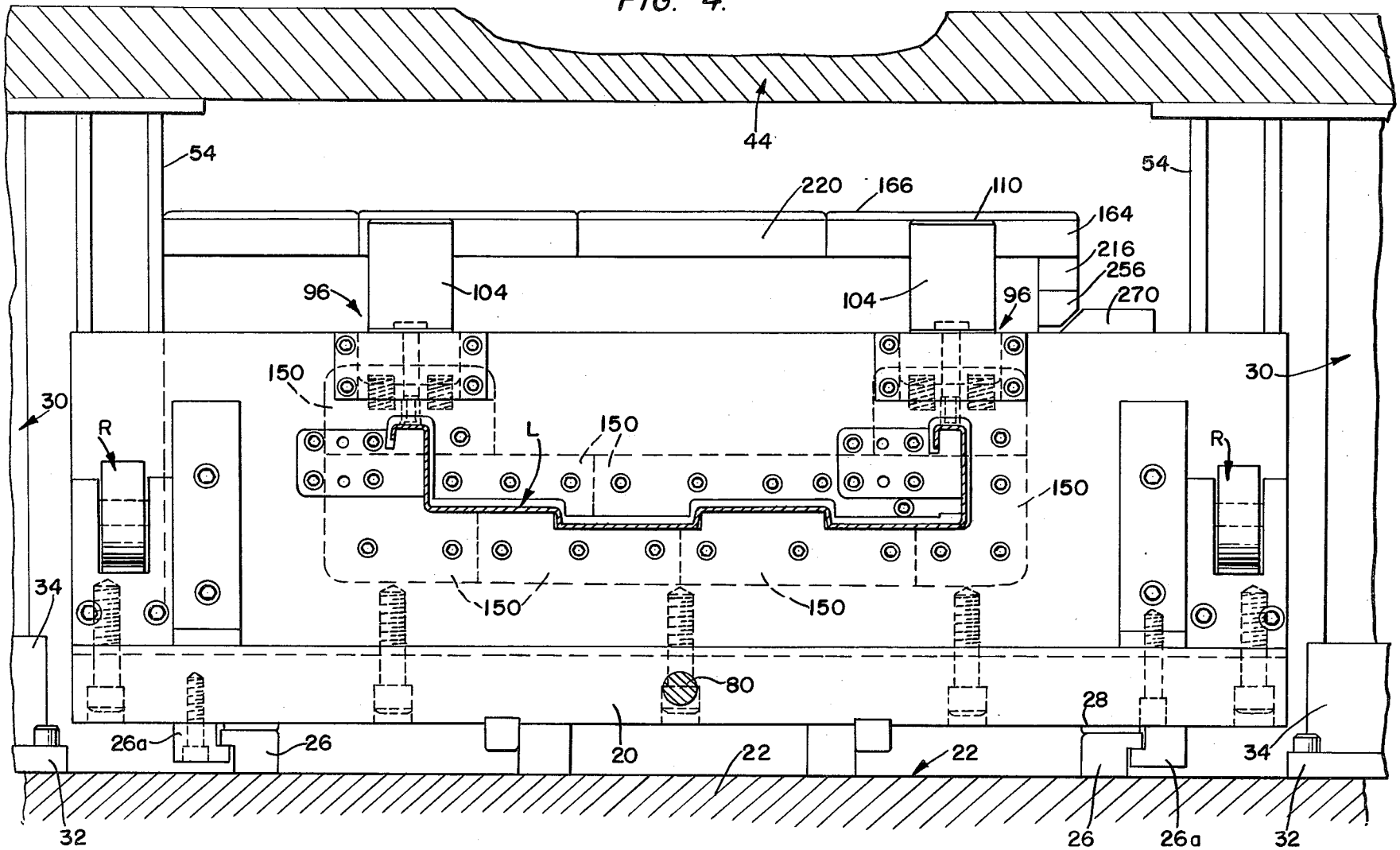
FIG. 4 is a front elevation taken along line 4—4 of FIG. 3 showing the entry side of the machine embodying the teachings of the present invention at the beginning of a press ram stroke.
Figure 6:
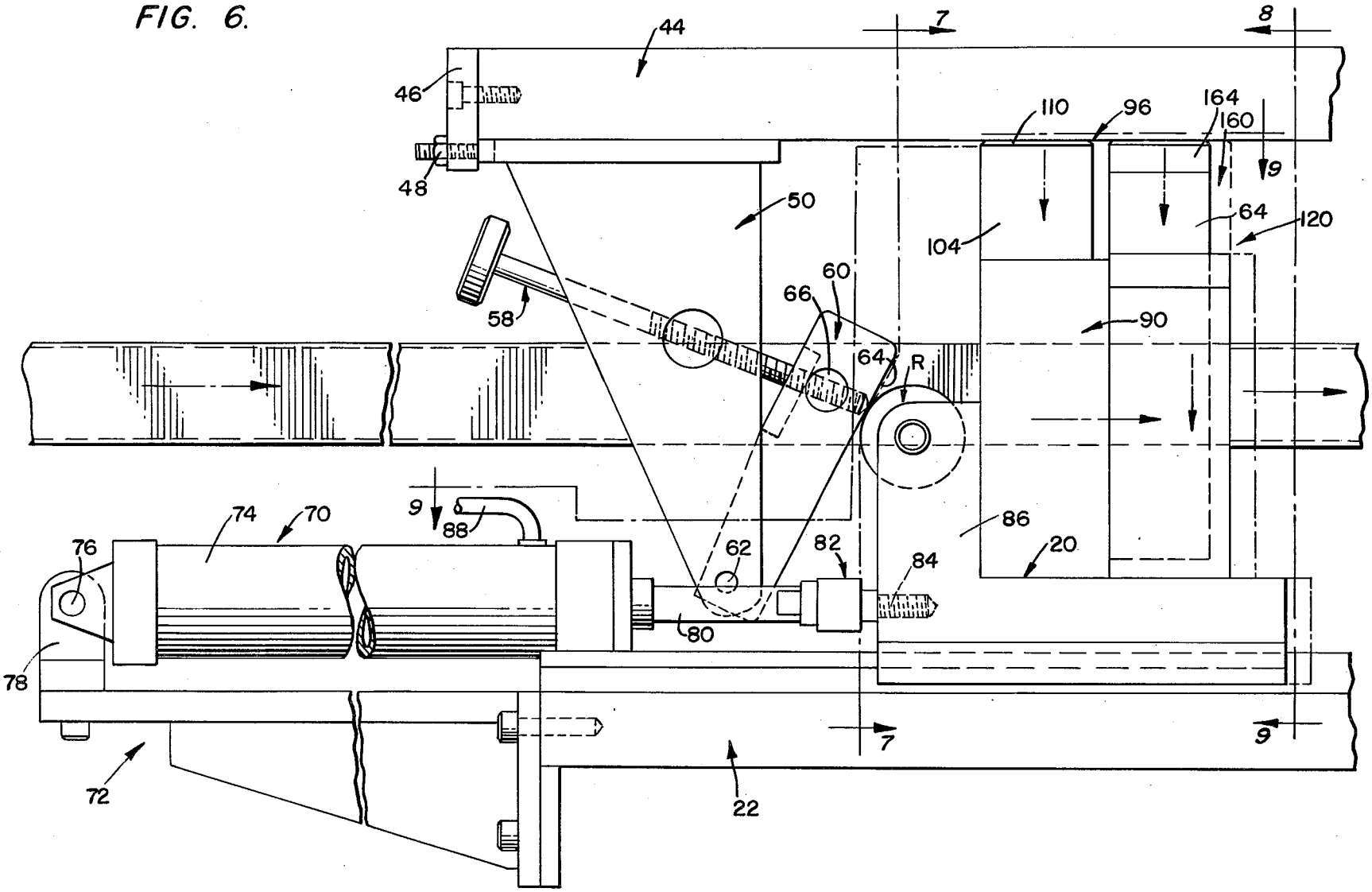
FIG. 6 is a side elevation of a press bed moving apparatus used in the machine embodying the teachings of the present invention showing the press bed at the end of the press ram stroke.
Figure 7:
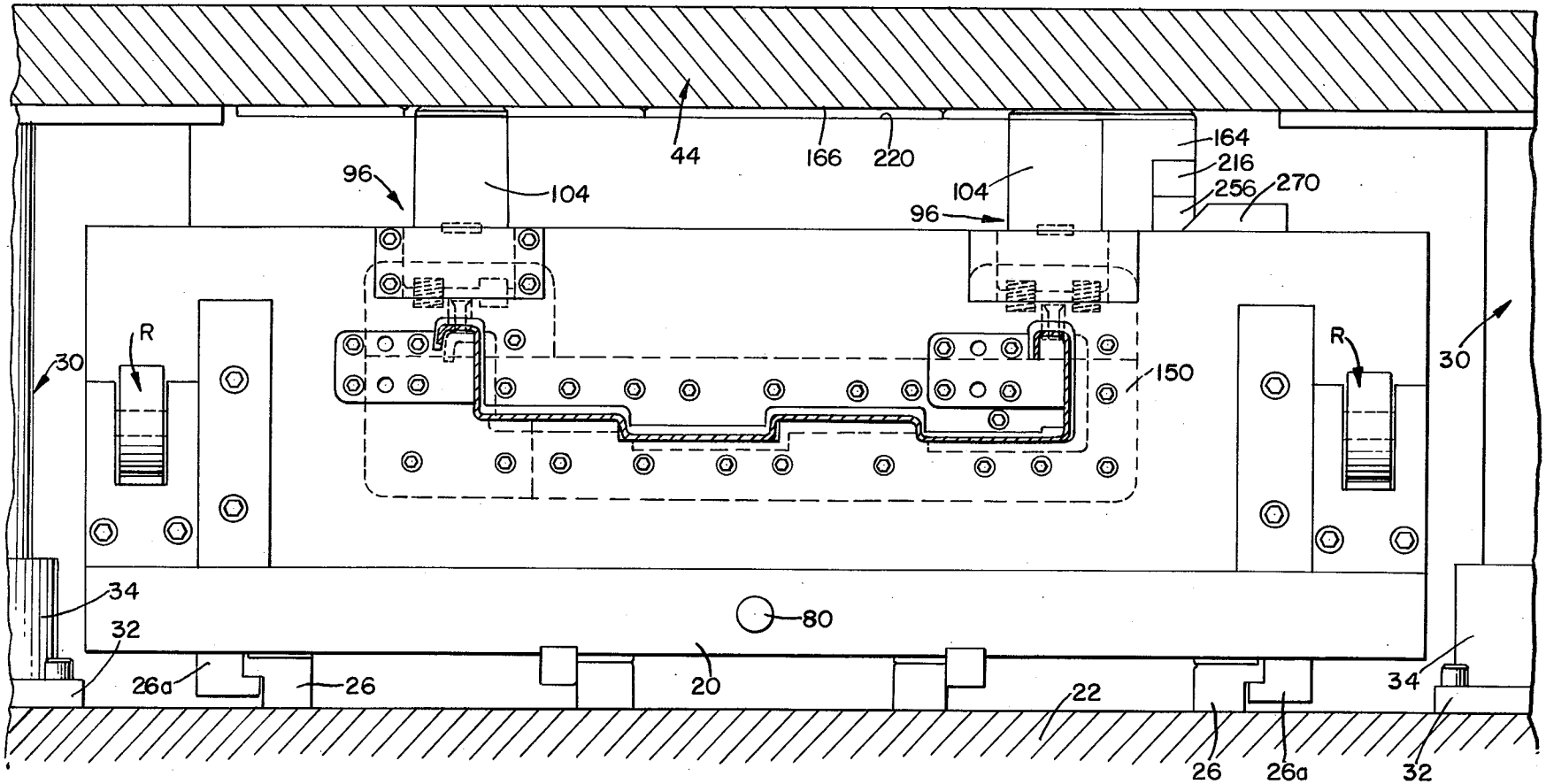
FIG. 7 is a front elevation taken along line 7—7 of FIG. 6 showing the entry side of the machine embodying the teachings of the present invention at the end of a press ram stroke.

Attaching plates 46 and fasteners 48 attach the upper ends of a pair of control arms 50 to the press ram 44 so the arms 50 depend downwardly therefrom. Each arm 50 has a yoke 52 at the lower end thereof and a pair of spaced sides 54 at the upper end thereof. A jack screw 58 is connected to each arm by a screw mounting member 59 extending between and attached to the sides 54. As shown in FIGS. 3 and 6, a roller contacting member 60 is attached to each arm 50 by the yoke 52 and a pin 62. The contacting member extends upwardly from the pin 62 and has a roller contacting surface 64 thereon. The roller contacting member is attached to the jack screw 58 by an attaching member 66 located near the top thereof. Movement of the jack screw adjusts the included angle between the member 60 and the arms 50. As is usual in flying cutoff machines, the movable die set has a roller R mounted thereon which is contacted by the contacting surface 64 as the press ram moves downwardly to move that die set in the direction of material flow. The angular orientation of the contacting member 60 determines the speed of forward movement (with respect to the flow direction of the material) of the die set, and hence the speed of forward movement of the machine. The die set moves on the cooperating guide rails 24, 24*a* and 26, 26*a*.

A die set return mechanism 70 is shown in FIGS. 2, 3 and 6 to include a mounting bracket 72 attached to the mounting means 22 and extending outwardly therefrom. A fluid cylinder 74 is pivotally attached at one end thereof by a pin 76 to an eye bracket 78 mounted on the mounting bracket upper surface. A ramrod 80 extends outwardly from the fluid cylinder and is connected at one end to a piston located within the cylinder and at the other end to the die set by a coupler mechanism 82 which includes a screw 84 threadably coupled to upstanding arm 86 of the die set. A fluid hose 88 is also attached to the fluid cylinder to actuate the piston and hence move the ramrod to thereby move the die set.

Movement of the die set is apparent from the above description and the disclosure in FIGS. 3 and 6. Upon downward movement of the press ram, the roller contacting member contacts the roller R and due to the angular disposition of the member 60, continued downward movement of the press ram causes the die set to move forwardly. Upon completion of the press ram downward stroke, the die set coasts forwardly for a predetermined distance as indicated in FIG. 6, then is moved backwards by the return mechanism 70 in time to execute the next flying cycle.

Figure 9:
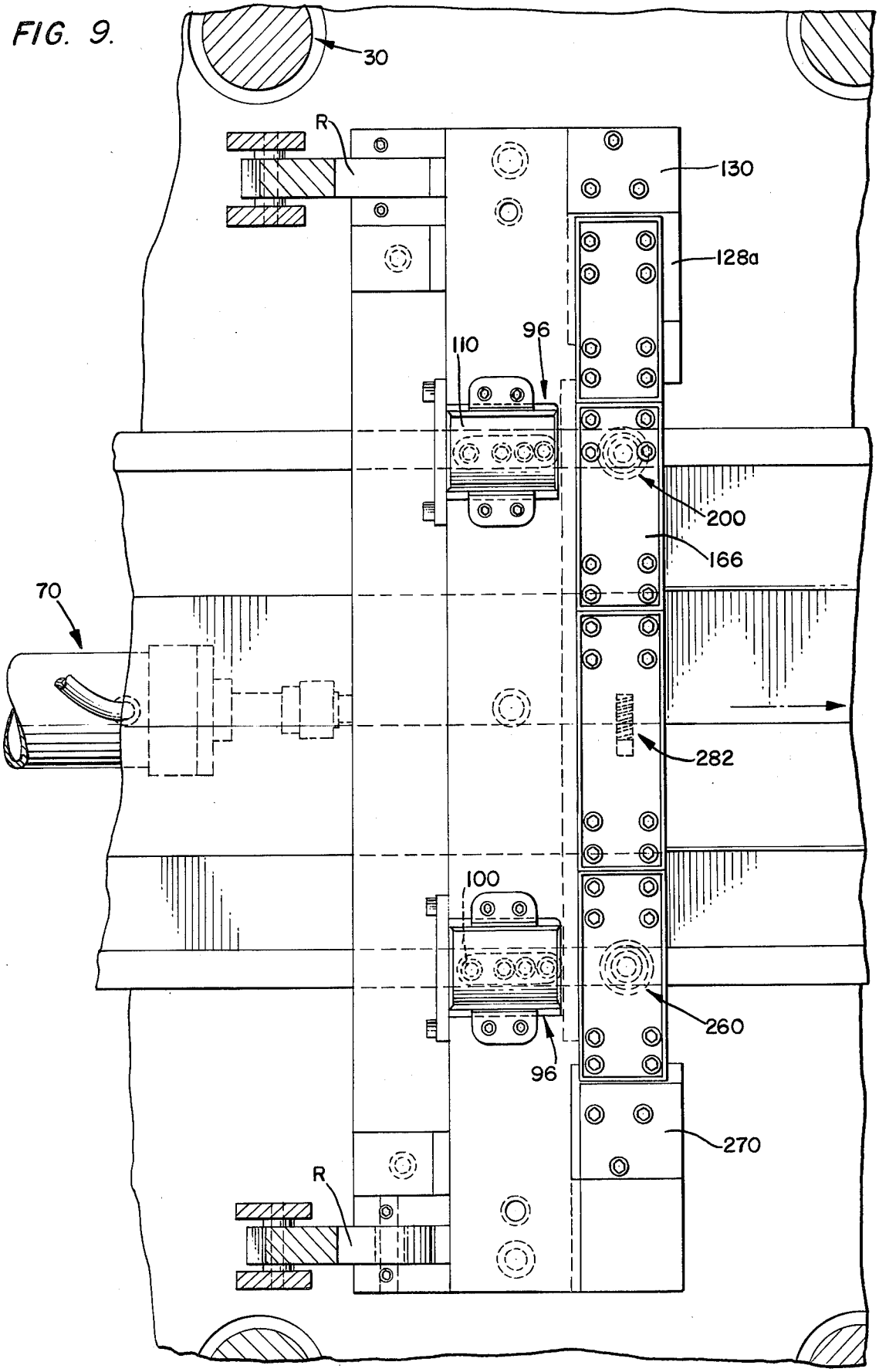
FIG. 9 is a plan view of the machine taken along line 9—9 of FIG. 6.

As shown in FIGS. 2, 3 and 6, a mounting frame 90 is mounted on the die set 20 for movement therewith. The frame 90 will hereinafter be referred to as the fixed die and includes a punch mechanism 96 thereon, as shown in FIGS. 3 and 6. The fixed die is of the usual construction, and as indicated in FIG. 9, includes four punches 100 for punching holes H adjacent that edge of the continuous length of material which will form the leading edge of the next panel. As this edge is fixed, there is no problem punching holes H. As shown in FIGS. 3 and 6, the punch mechanism includes a spacer member 104 which is contacted by the press ram to be driven vertically downward thereby to actuate the punches in the usual manner as the die set and fixed die move with the material. The usual striker plates 110 are mounted on top of the striker to be contacted by the press ram.

Figure 8:
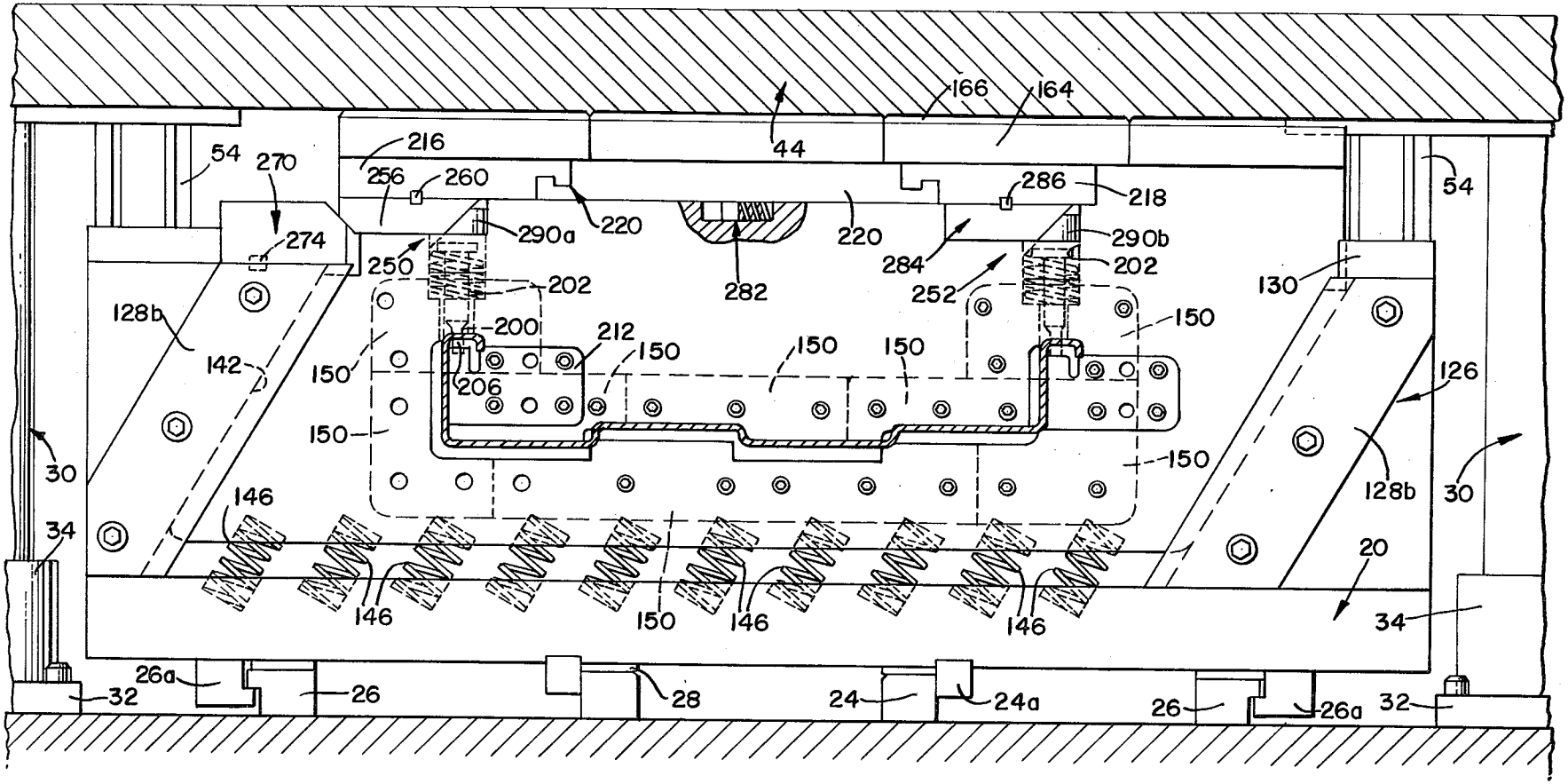
FIG. 8 is a back elevation taken along line 8—8 of FIG. 6 showing the exit side of the machine embodying the teachings of the present invention at the end of a press ram stroke.

A movable die 120 is mounted on the die set forwardly of the fixed die. As shown in FIGS. 5, 8 and 9, the movable die includes a jib block 126 fixedly mounted on the die set. The block 126 includes a pair of upwardly inclining legs 128*a* and 128*b*, with leg 128*a* having a retainer plate 130 mounted on the top thereof by fasteners, such as bolts 132. The movable die is of the type usual to the slugless-type cutoff devices, and thus includes a slide block 140 slidably mounted in guide tracks 142 defined in the jib block. Downward force exerted on the top of the slide block 140 thus causes that block to be forced against the guide tracks 142 which cause that block 140 to move downward and to the left in FIG. 5 as the press ram moves downwardly from the FIG. 5 position to the FIG. 8 position. Springs 146 return the slide block to the rest position after a cut, and are mounted in bores defined in the die set and in the slide block to be inclined and essentially parallel to the direction of travel of the slide block. The slide block moves at an angle with respect to the vertical to perform the slugless cutoff, as opposed to a vertical movement of a blade device in a slug-type cutoff device. The slide block includes a plurality of shear blocks 150 mounted thereon adjacent the panel flow path. A slide block actuating mechanism 160 is shown in FIGS. 3, 4, 5 and 9 to include a plurality of bars attached to the slide block and a plurality of spacers 164 mounted on the bars. The bars will be discussed below in greater detail. A plurality of striker plates 166 are mounted on the spacers and are contacted by the press ram during the downward movement thereof to actuate the slide block in the manner usual to slugless cutoff devices. The slide block thus moves downward and sidewalls under the influence of the downward ram movement as is evident from FIG. 5 upon downward movement of the press ram to cut off a panel from the length of material. Of course, movement of the slide block is synchronized with respect to the movement of the fixed die punches and material flow speed to execute the panel cut off in timed relation with respect to the other steps in the procedure.

The flying cutoff machine 10 embodying the teachings of the present invention is slugless and also includes means for punching holes in the panel during the panel cutoff step. As noted above, accurate punching of holes requires a vertical movement of the punching device, whereas a slugless cutoff step requires a slanted movement of the cutoff blade. Such diverse movements are combined in the machine embodying the teachings of the present invention so that the forward holes, illustrated by hole H' in FIG. 1, are made a the same time cut C is being made in a slugless manner. It is here noted that other hole patterns can be made and plurality of holes H' can be made without departing from the scope of the present invention wherein holes are punched while a panel is being cut off in a slugless flying cutoff machine.

The punch and cutoff step is performed in machine 10 by the movable die 120. The means for cutting the panel has been described above, and attention is now directed to FIGS. 5 and 8–11 for a description of a punching means 190. With respect to FIGS. 5 and 11, the punching means 190 is seen to include a punch 200 mounted in an eccentric hole 202 defined in the slide block 140 and has a head 204 and a punch tip 206 connected thereto by a trunk section 208. A die button device 210 is mounted on the slide block and held thereon by a botton holder 212 to receive the punch tip after that tip passes through the panel flange to define the hole H'. A die spring 214 returns the punch to the rest position after executing a punching movement. As is also shown in FIGS. 5 and 8, a pair of clamp bars 216 and 218 are attached to the spacers and are both coupled to a pusher bar 220 by couplings 222. Suitable fastening means such as bolts or the like (not shown) are used to couple the clamp bars to the spacers so the spacers, striker plates, clamp bars and pusher bar move together as will be discussed below.

As above-discussed, the punching movement is vertical, whereas the slugless cutoff movement is downward and sideways. As best shown in FIGS. 5, 8, 10 and 11, the slide block sideways and downward movement is converted into strictly downward punch movement by cam means 250 and 252. The cam means 250 includes a generally trapezoidal wedge block 256 attached to clamp bar 216 by a key 260 for movement therewith. The wedge block includes a pair of slanted faces 262 and 264 which are downwardly convergent with respect to each other and the press ram. A retainer cam block 270 is mounted on jib block arm 128*b* by a plurality of fasteners 272 and a key 274, and the slide block 140 has a cutout section 276 defined therein to receive the retainer cam block 270. The cam block 270 has a slanted surface 280 which is facially opposed to sliding face 262 of the wedge block to contact same during downward movement of the press ram. During the press ram downward movement, the face 262 contacts and slides over the face 280 so that the faces move from the relative orientation thereof shown in FIG. 5 near the beginning of the press ram downward stroke to the relative orientation thereof shown in FIG. 8 near the end of the press ram downward stroke. The angular disposition of the faces 262 and 280 is selected to correspond to the angular disposition of the slide block movement as defined by the guide tracks 142 and the angular disposition of the jib block arms with respect to the vertical.

The operation of the slide block is best understood with reference to FIGS. 5 and 8. The press ram moves downwardly from the FIG. 5 starting position and contacts the striker plates thereby forcing the slide block downwardly. The slide block is slidably mounted in the guide tracks 142 to be forced to move downwardly and to the left of FIG. 5, thereby executing the proper movement to effect a slugless cutoff of the material to form a panel P. After the press ram has moved a predetermined distance, the face 262 of wedge block 256 contacts the face 280 of the retainer cam 270. The retainer cam is fixed, and thus the wedge block 256 is forced to move horizontally to the right in FIGS. 5 and 10 with the faces 262 and 280 sliding from the FIG. 5 relative orientation to the FIG. 8 relative orientation. The horizontal movement of the wedge block 256 is transmitted to the clamp bar 216 and to the other clamp bar 218 by pusher bar 220 to thereby cause the bars 216 and 218 to move horizontally to the right in conjunction with the wedge block 256. Thus, the top portion of the slide block is displaced horizontally to the right in FIGS. 5 and 10 as the press ram moves into the FIG. 8 orientation.

A ram spring mechanism 282 is mounted in the slide block and contacts a lug to be connected to the pusher bar to assist in the return of the bars and wedge blocks to the FIG. 5 orientation as the pusher ram returns to the rest position in preparation for the next cycle.

A further wedge block 284 is mounted on the clamp bar 218 by a key 286 for movement therewith. The movement of wedge block 284 matches that of the wedge block, 256, and thus includes a downward component followed by a horizontal component after the wedge block 256 contacts the fixed retainer cam 270.

Figure 10:
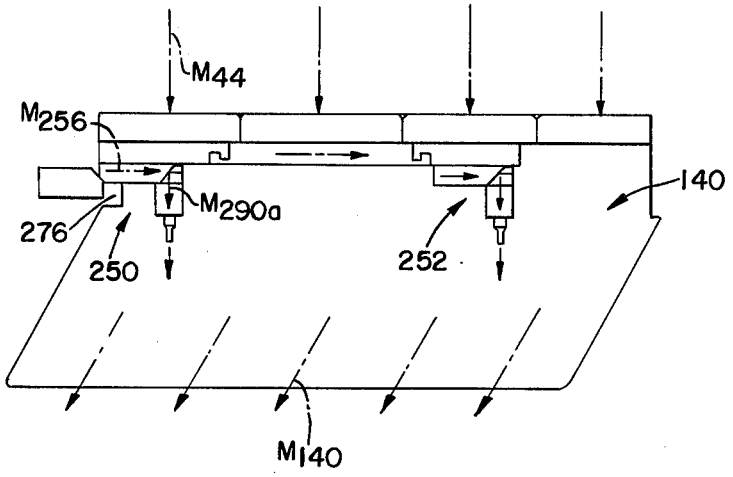
FIG. 10 is a diagram showing the movements of the elements of the machine as a result of the double cam arrangement of the present invention.

The just-described slide bar and wedge block movement can also be understood by referring to FIG. 10, wherein the vectors correspond to the elements just described. Thus, vector $M_{256}$ represents the movement of wedge block 256, and so forth. The bidirectional movement (i.e., downward, then primarily horizontal) of the elements is thus evident from this Figure.

Figure 11:
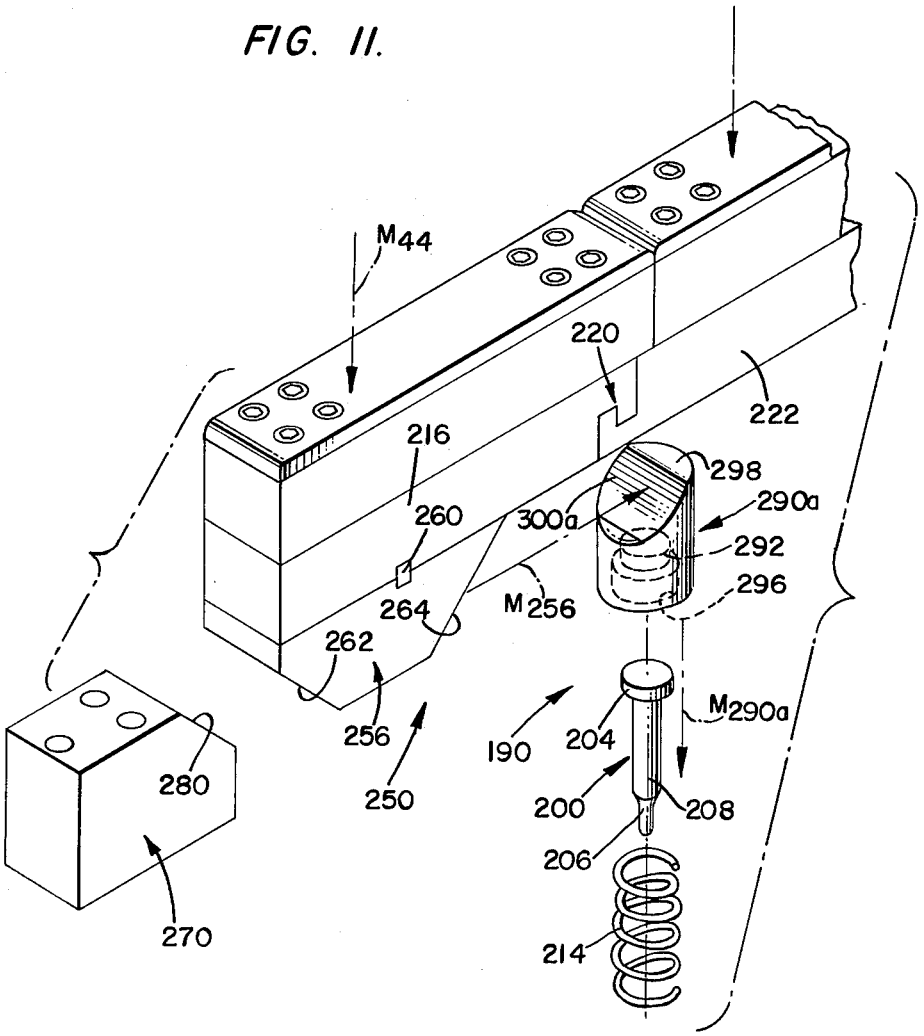
FIG. 11 is an exploded perspective showing the camming elements used in the flying punch and cutoff machine embodying the teachings of the present invention.

As also shown in FIGS. 5, 8 and 11, both cam means 250 and 252 include punch driver cams 290*a* and 290*b*, respectively. The cams 290*a* and 290*b* are generally cylindrical and each includes a bore 292 in which a punch head 204 is retained and a counterbore 296 in which a return spring 214 is seated. A top surface 298 of each punch driver cam contacts the lower surface of the superjacket clamp bar, and a slanted surface 300 is defined in each driver cam. The slanted surface 300*a* of cam 290*a* contacts the slanted surface 264 of the wedge block 256, and the slanted surface 300*b* of the cam 290*b* contacts slanted surface 304 of wedge block 284 of the cam means 252. The slanted faces 300*a*, 264 and 300*b*, 304 are angularly disposed with respect to each other and with respect to the vertical to correspond to the angle of inclination of the jib arms. The angular disposition and orientation of the faces 300*a*, 264 300*b* and 304 will be apparent from the discussion below.

As the wedge blocks 256 and 284 move horizontally to the right under the influence of the press ram and the fixed retainer cam 270, the slanted surfaces 264 and 304 contact the punch driver cam surfaces 300*a* and 300*b* respectively and ride up and over those surfaces from the FIG. 5 relative orientation to the FIG. 8 relative orientation, thereby forcing the punch driver cams vertically downward from the FIG. 5 position above flange F of the panel into the FIG. 8 position with punch tips 206 extending through the flanges to define holes H'. The punch return springs 214 move the punches back into the FIG. 5 position as the press ram is moved back into the cycle starting position.

The movement of the punch driver cams can also be seen in FIGS. 10 and 11. Thus, the movement of the punch driver cams relative to the wedge blocks and other moving elements can be seen vectorally in FIGS. 10 and 11.

Thus, the downward movement of the press ram is translated into a sideways movement of the slide block and a downward movement of the punches to thereby execute a hole punching operation at the same time a flying slugless cutoff operation is performed. The angular orientation, disposition and shape of the wedge and cam blocks and the surfaces thereof, as well as the spacing between the press ram and the striker plates and the speed of the press ram downward movement, are selected so that the cutoff and punching steps are completed at the desired time in the cycle of the press ram. Such timing is adjusted according to material feed speed and the like, and the nature and degree of such adjustments will occur to those skilled in the art without further exposition. Of course, requirements for the materials and the like will also occur to those skilled in the art.

It is noted that proper timing requires the press ram to contact the slide block striker plates before contacting the striker plates of the fixed die, and such sequencing is accomplished by extending the movable die spacer closer to the press ram than the fixed die spacer as best shown in FIG. 3. As an example, the shear moves $\frac{1}{8}$ inch while the punch moves 1/64 inch, and the shear moves at an angle of 30° with respect to the vertical. In one embodiment, the slanted surfaces are at 45° angles. Other movements can be used, and the just-mentioned movement is only an example and is not intended as a limitation.

Alternative embodiments of the machine 10 can include punches producing a punching pattern different from that shown in FIG. 1 on both the leading edge of the panel and the trailing edge of the panel. Punch templates can also be included.

One embodiment of the present invention is used in conjunction with the material flow rate or line speed of 40 feet per minute. The press executes 150 strokes per minute with a press stroke of 4 inches. The distance between the lower surface of the press ram 44 and the top surface of the striker plates of the fixed die is $3\frac{3}{4}$ inches, and the die moves forwardly (i.e., to the right in FIGS. 3 and 6) 1.44 inches when impacted by the ram. The die moves 0.083 inches during the cutoff and punch operation and coasts to a stop $3\frac{3}{4}$ inches from the starting point. The coast distance is indicated in FIG. 6.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A flying panel cutoff and punch device comprising:

a slugless cutoff means and actuating means therefor for shearing panels of predetermined length from a continuous length of material;

a punch means on said slugless cutoff means for punching holes in a panel; and punch actuating means on said cutoff means for actuating said punch while said cutoff means shears such panel from a length of material so that said punch means and said slugless cutoff means are actuated at the same time, said punch actuating means including a plurality of cams, said plurality of cams including a wedge block on the cutoff means and a retainer cam on a stationary member of the device.

2. The device of claim 1 wherein said cams further include a punch driver cam on said cutoff means contacting said wedge block.

3. The device of claim 2 wherein said punch driver cam is cylindrical.

4. The device of claim 2 wherein said retainer block has a sloped surface and said wedge block has a pair of sloped faces, one of which contacts said retainer cam sloped surface.

5. The device of claim 4 wherein said punch driver cam has a sloped face contacting the other sloped face of said wedge block.

6. The device of claim 5 further including a second wedge block on said cutoff means and a second punch driver cam on said cutoff means.

7. The device of claim 6 further including a coupling means on said cutoff means coupling said first and second wedge blocks together.

8. The device of claim 7 wherein said coupling means includes a pair of clamp bars and a pusher bar.

9. The device of claim 8 further including a return spring on said cutoff means for moving said coupling means.

10. The device of claim 8 further including keys coupling said wedge blocks to said clamp bars.

11. The device of claim 1 wherein said slugless cutoff means moves sideways when said punch means is moving vertically downward.

12. The device of claim 1 wherein said punching and cutting occur simultaneously.

13. The device of claim 1 including a downwardly movable press ram.

14. The device of claim 13 further including a first ram striker means on said slugless cutoff means.

15. The device of claim 14 further including a second punching means which includes a second ram striker means thereon.

16. The device of claim 15 wherein said press ram in a rest position is spaced from said striker means and is located farther from said first striker means than from said second striker means.

17. The device of claim 13 wherein said actuating means includes an actuating arm connected to said press ram and having a sloped surface thereon, and a roller on said cutoff means contacting said sloped surface to move said cutoff means in the direction of flow of material as said press ram moves downwardly.

18. The device of claim 17 further including means for moving said cutoff means in a direction opposite to the direction of material flow.

19. The device of claim 1 further including guide means for guiding said cutoff means downwardly and sideways during cutoff of a panel from a continuous length of material.

20. The device of claim 19 further including means for moving said cutoff means upwardly and sideways after a panel has been cut off from a continuous length of material.

* * * * *